United States Patent [19]

Wood

[11] Patent Number: 4,809,964

[45] Date of Patent: Mar. 7, 1989

[54] APPARATUS AND METHOD FOR CONVERTING BUNDLED SIGNATURES TO A SHINGLED STREAM

[75] Inventor: James R. Wood, County of Marion, Ill.

[73] Assignee: St. Denis Manufacturing Co., Effingham, Ill.

[21] Appl. No.: 39,297

[22] Filed: Apr. 17, 1987

[51] Int. Cl.[4] ..... B65H 43/00; B65H 31/00; B65G 47/31

[52] U.S. Cl. ..... 270/58; 198/462; 198/627; 198/418.9; 271/151; 271/209; 271/216; 271/188

[58] Field of Search ..... 270/56, 58, 54; 271/149–151, 8.1, 3.1, 209, 188, 34, 216; 198/627, 423, 462

[56] References Cited

U.S. PATENT DOCUMENTS

| | | | |
|---|---|---|---|
| 3,342,117 | 9/1967 | Cole | 270/58 |
| 3,881,718 | 5/1975 | Rana et al. | 271/150 |
| 3,881,719 | 5/1975 | Schmermund | 271/150 |
| 3,885,781 | 5/1975 | Krebs | 271/151 |
| 3,894,732 | 7/1975 | Muller | 271/150 |
| 3,945,633 | 3/1976 | Knopp | 271/150 |
| 4,177,982 | 12/1979 | Bewersdorf et al. | 271/151 |
| 4,531,343 | 7/1985 | Wood | 271/216 X |
| 4,588,180 | 5/1986 | Ballestrazzi et al. | 271/209 |
| 4,607,831 | 8/1986 | Raybuck | 270/58 |
| 4,618,136 | 10/1986 | Pessina et al. | 271/209 |

FOREIGN PATENT DOCUMENTS

| | | | |
|---|---|---|---|
| 969204 | 6/1975 | Canada | 271/209 |

*Primary Examiner*—Eugene H. Eickholt
*Attorney, Agent, or Firm*—Paul M. Denk

[57] ABSTRACT

Bundled signatures are placed on a first set of conveyor belts which move the signature bundle to a shingling station. A pair of side belts at the shingling station are spaced so that the signatures are individualy bowed forwardly upon encountering the belts so as to separate each signature from the other signatures of the bundle. A third set of conveyor belts move the bowed signatures upwardly in a shingled condition from a discharge site of the side belts.

17 Claims, 2 Drawing Sheets

APPARATUS AND METHOD FOR CONVERTING BUNDLED SIGNATURES TO A SHINGLED STREAM

BACKGROUND OF THE INVENTION

This invention relates to the handling of folded thin sheet material, and more particularly to apparatus and method for receiving stacked signatures of such material and feeding the signatures successively to another location.

The printing industry employs a wide variety of machines a convert plain paper derived from large rolls into completed magazines and books. Even so, some manual procedures remain in the process, and these procedures are usually quite expensive and introduce the element of human error into the overall printing process.

The modern printing press of the type used in magazine production operates quite rapidly and efficiently, usually printing several pages that are joined together in a single sheet, which sheet is normally folded in the press. This folded sheet is often combined with other folded sheets, but irrespective of whether or not it is folded, the product is referred to as a signature. The output of these printing presses is usually stacked or tied into bundles. A relatively large number of these stacks or bundles are produced with each stack or bundle containing like signatures and each signature usually being one or more folded sheets consisting of several pages of the magazine.

The stacks or bundles are delivered to collating and binding machines (collator/binders) which extract individual signatures from the stacks or bundles, assemble them in the proper order, and bind them together to form a completed magazine. Generally the stacks or bundles are placed in hoppers associated with the finishing machine, such as a collator/binder, and it is necessary to have a supply of signatures available in each of the hoppers of the machine to form the finished product. Before placing the signature in the hopper, it is necessary to break a stack or bundle of signatures into a stream of signatures in which the signatures are in shingled form.

Intermittent manual loading of a large bundle of signatures into a hopper may be unsatisfactory, since the impact of such a bundle of signatures dropped in the hopper may interfere with the proper operation of the feeding mechanism. However, to avoid this problem by manual feeding of relatively small portions of bundles into the hopper requires such frequent replenishment that an excessive amount of manual labor is involved. Moreover, the amount of floor space available for a machine which would automate this process is generally very limited.

In addition, physical type injury and stress is sustained by the worker who repeatedly manually feeds a number of bundles into the hoppers in preparation for binding into the magazine or book form. The worker must pick up a large stack of the signatures, manipulate his arms so as to arrange the load for stacking on an edge, joggle the volume of signatures, so as to break their aherence, and then arrange the bundle into position for loading into and passage through the hopper. To repeatedly perform this maneuver, each time as worker accommodating a large stack of heavy signatures, and this eventually causes corporal injury to the worker, resulting in disability. The current invention is intended to alleviate those type of prior experienced problems.

The bundle used to compactly store the signatures is often compressed tightly for a significant period of time. The ink used may tend to bond the paper product together, which is called "blocking". This blocking prevents efficient operation of the collator/binder. Present machines used to convert bundles of signatures into shingled streams are not believed to have completely solved the blocking problem.

Another difficulty which must be overcome is that the friction of one surface of paper sliding on another tends to open the outside page of the signature. When this "roll-out" occurs, the signature is rendered unfit for use until an operator manually restores it to its original folded condition. Present apparatus are severely affected by "roll-out" when signatures are produced with only one fold, leaving the other three sides open.

Current types of stream feeders normally employ air under pressure as a means for approaching the problem of achieving signature separation and to lubricate the signatures in preparation for their feeding towards the hopper and binder. Excessive use of high pressure air, and high volumes of air, are needed to operate that type of separator, to eliminate signature blocking, and, as can be readily understood, that type of generated energy, in the form of elevated air pressure, is quite expensive to obtain and use.

SUMMARY OF THE INVENTION

Among the various objects and features of the present invention may be noted as provision of an apparatus and a method for converting signature bundles into a shingled stream of signatures which minimizes the need for manual handling of the signature bundles and the signatures themselves.

Another object of the present invention is the provision of such apparatus and method which may continuously, if desired, supply a shingled stream of signatures to a hopper or the like of a finishing machine.

A third object of the present invention is the provision of such apparatus and method which automatically and efficaciously separate the individual signatures from the bundle.

A fourth object of the present invention is the provision of such apparatus which makes up a minimal amount of floor space.

A fifth object of the present invention is a provision of such apparatus and method which eliminates or significantly reduces friction between signatures as the shingled stream of signatures is generated from the bundle.

A sixth object of the present invention is the provision of such apparatus which provides a convenient loading height for the signature bundles while providing the ability to elevate the stream to the proper height for feeding to the finishing machine pockets or hoppers.

Other objects and features will be in part apparent and in part pointed out hereinafter.

Briefly, apparatus of the present invention for converting bundled signatures to a shingled stream suitable for feeding a finishing machine hopper or the like includes a first set of conveyor belts for moving a signature bundle to a shingling station. The top run of the belts of the first set generally define the plane along which the handle is moved. A drive mechanism is provided for driving the first set of conveyor belts to cause a signature bundle placed thereon to move along the path defined by the first set of belts towrd the shingling station. A pair of side belts defines the beginning of the shingling station. These side belts extend upwardly from the plane defined by the first set of belts on opposite sides of the path of the signature bundle. The spacing between the side belts is less than a predetermined signature width so that signatures from a bundle of signatures of the predetermined width disposed on the first set of conveyor belts with the longitudinal axis of the bundle generally parallel to the direction of travel of the bundle are bowed as they encounter the side belts to separate each signature from the other signatures of the bundle. The side belts are driven so tht the inner run of the side belts moves in the same direction as the upper run of the first set of belts. A third set of conveyor belts is included for moving the bowed signatures upwardly in shingled condition from a discharge site of the side belts.

The method of the present invention includes the steps of conveying a signature bundle along a generally horizontal path to a shingling station, the signatures of the bundle being disposed generally at right angles to the path. The signature bundle is fed through a restricted zone defined by a pair of side belts to bow the signatures of the bundle as they encounter the side belts to separate each signature from the other signatures of the bundle. The bowed signatures are conveyed upwardly in shingled condition from a discharge site of the side belts.

BRIEF DESCRIPTION OF THE DRAWINGS

Similar reference characters indicate similar parts throughout the several views of the drawings.

DESCRIPTION OF THE PREFERRED EMBODIMENT

Figure 2:
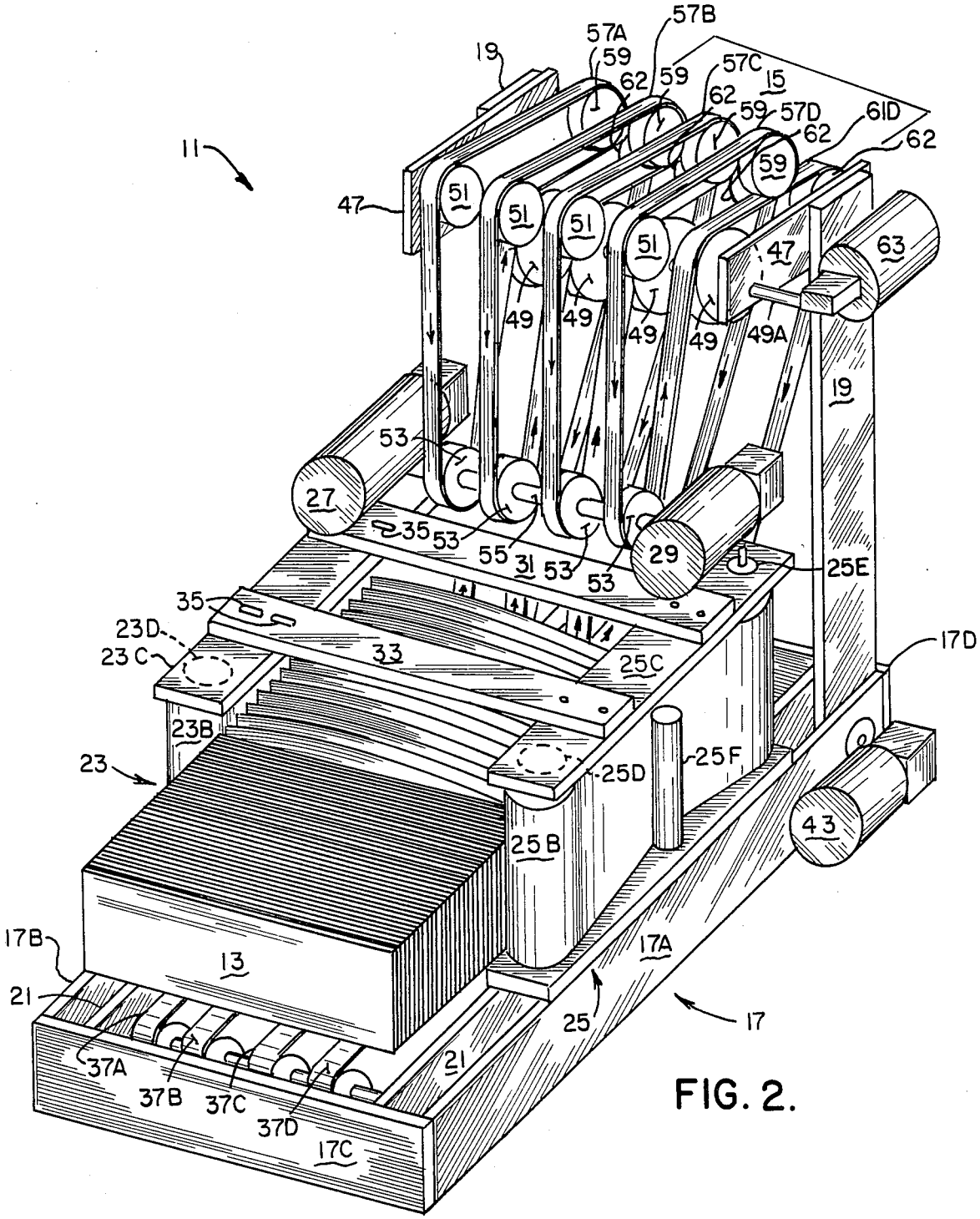
FIG. 2 is a view similar to FIG. 1 illustrating the operation of the apparatus of the present invention.

An apparatus 11 of the present invention is particularly well suited for taking a stack or bundle of signatures 13 (FIG. 2) and converting them to a shingled stream of signatures illustrated by the single signature 15 in FIG. 2. This shingled stream of signatures is then supplied to a hopper or pocket of a finishing machine such as a collator/binder (not shown).

Apparatus 11 includes a relatively rigid fixed frame having a base 17 made out of four base members 17A through 17D, members 17A and 17B forming the sides of the apparatus base and members 17C and 17D forming the ends of the base 17. A pair of post 19 extend upwardly from the corners of the base adjacent base member 17D. A pair of ribs 21 extend from base member 17C longitudinally to base member 17D and are suitably secured to the base. In addition to supplying additional rigidity to base 17, ribs 21 in connection with base members 17A and 17B provide a suitable support for a pair of side belt assemblies 23 and 25.

Each side belt assembly includes a platform 23A and 25A on which are mounted side belts 23B and 25B for conveyor movement in the direction indicated by the arrows. Each side belt assembly terminates at its upper end in a head beam 23C and 25C, respectively. Each belt assembly includes a pair of shafts 23D, 23E and 25D, 25E (shaft 23E not being shown) rotatably mounted between the head beam and the platform of its respective side belt assembly. The rear shaft of each side belt assembly is driven by an electric motor drive assembly 27 and 29 as indicated to drive the belts along their courses at a suitable rate of, for example, six inches per minute. Each side assembly includes an idler roller, idler roller 25F being the only one shown, of conventional construction which may be used to adjust the tightness of the respective side belts. Each belt is tightened only to take up excessive slackness. They are left moderately slack and in particular are not tightened to the rigid state.

Extending from side to side of apparatus 11 are a pair of spacing adjustment beams 31 and 33. These beams are fixedly secured to head beam 25C of side belt assembly 25 and are provided with adjustment slots 35 by means of which they may be secured to head beam 23C of side belt assembly 23. Assembly 23C may be moved to the desired position with respect to side belt assembly 25 and suitable fasteners may then be tightened in the adjustment slots of spacing adjustment beams 31 and 33 to hold the side belt assemblies in the desired relative position. Similar adjustment features may be provided to secure platform 23A of side belt assembly 23 to its support, namely base member 17B and rib 21. Alternatively, side belt assembly 23 may merely rest upon its support while side belt assembly 25 is suitably secured to base 17 and rib 21.

Figure 1:
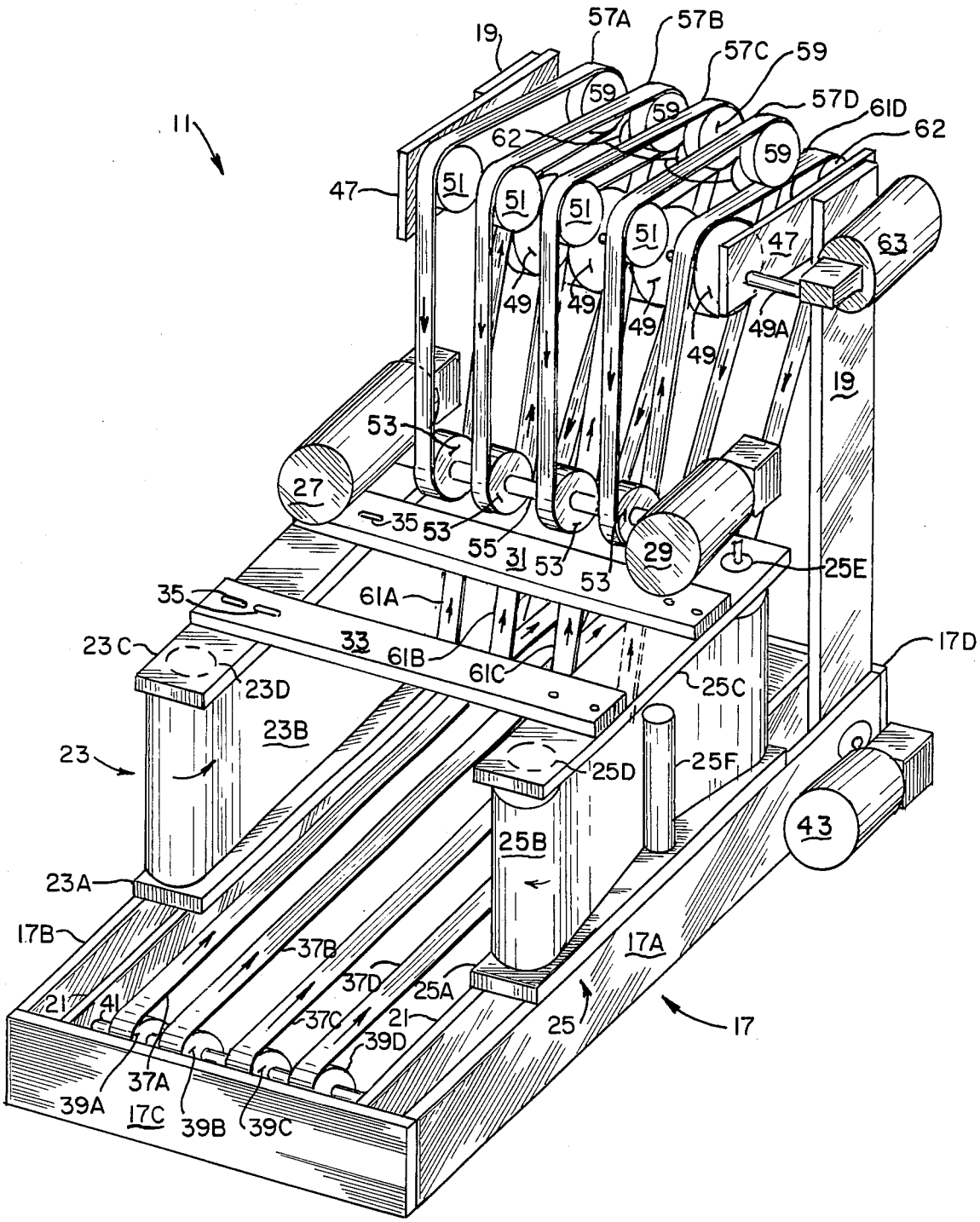
FIG. 1 is a perspective view of converting apparatus of the present invention.

Apparatus 11 also includes a set of conveyor belts 37A through 37D which are suitably mounted for conveyor motion in the direction indicated by the arrows in FIG. 1 on a set on four rollers 39A through 39D respectively. Rollers 39 are suitably mounted upon a spindle 41 suitably mounted for rotation in ribs 21. Similar rollers (not shown) are disposed at the opposite end of appartus 11, which rollers also have the belts 37 suitably mounted thereon. The rollers not shown are driven at the desired rate of speed by a variable speed motor assembly 43 suitably mounted to base 17. The speed of the belts 37 is approximately six inches per minute on the average, although they can be run as low as 2 inches per minute or as high as 10.5 feet per minute or the like. The speed of belts 37 is generally the same as the speed of side belts 23B and 25B, although it may be desirable to run the side belts at a slightly higher speed than the conveyor belts 37.

Posts 19 each have an arm 47 extending forwardly therefrom to support a set of drive rollers 49 and a second set of conveyor rollers 51. Rollers 49 are mounted on a shaft 49A for rotation while rollers 51 are mounted on a shaft for rotation which is not shown for clarity. Disposed below rollers 51 is a second set of rollers 53 suitably mounted on a shaft 55 for rotation, shaft 55 being secured by a suitable manner (not shown) to the frame of apparatus 11. A set of four belts 57A through 57D are disposed over rollers 51 and 53 and a third set of rollers 59. Rollers 59 are suitably secured to a shaft (not shown for clarity) which is rotatably journaled in arms 47 near the rearward end thereof. A third set of belts 61A through 61D are disposed with their forwardmost run in close proximity to belts 57 to provide a nip therebetween which, as will be seen, draws signatures from the bundle upwardly in a shingled stream. Belts 61 are mounted at the base of the apparatus on an additional set of rollers (not shown) diposed below the upper surface of belts 37 and at the upper rear of the apparatus on a set of rollers 62. A motor 63 drives rollers 49 to cause belts 61 to lift signatures from the bundle upwardly as indicated by the arrows on belts 61 in FIG. 1. Belts 57 are backing belts which hold the signatures lifted by belts 61 firmly between belts 57 and 61 to form a shingled stream moving generally vertically upwardly from conveyor belts 37. The speed of lifting and backing belts 57 and 61 is generally tend times to sixty times the speed of the table belts 37 and side belts 23 and 25, the particular speed being determined by the signature thickness and the particular shingle thickness.

Turning to FIG. 2, a bundle 13 of signatures having a thickness of, for example, 0.004 inches is shown being conveyed forwardly by belts 37 to a shingling station defined by side belts 23B and 25B. Th spacing between side belts 23B and 25B is selected to be slightly less than the width of the signatures, which are oriented perpendicularly with respect to the path of travel of belts 37 so that each signature as it encounters the side belts is bowed forwardly as shown in FIG. 2. This bowing action ruptures the ink to fiber bonding between the adjacent signatures, thereby separating them prior to formation of the shingled stream.

Figure 3:
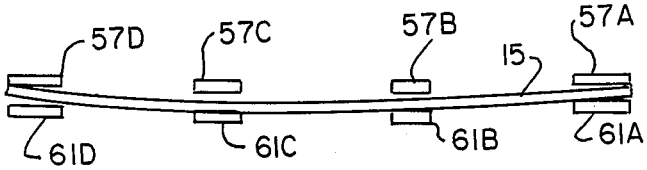
FIG. 3 is schematic illustrating the relative placement of the discharge belts of the apparatus of FIG. 1.

The side belts carry the individual signatures to the discharge site of the side belts, defined by lifting belts 61. Belts 61 at this point draw the foremost signature generally vertically upwardly into the nip formed between lifting belts 61 and backing belts 57. As shown in FIG. 3, this nip may have generally the same bowed configuration as the signature 15 itself so that any signature is readily accommodated by the lifting and backing belts without jamming.

Thus, a stream of signatures is lifted vertically by the lifting 61 and backing belts 57. These belts execute a generally right angle as they pass over rollers 49 so that the vertically lifted signatures are disposed in a horizontal orientation such as the signature 15 shown in FIG. 2. Of course, the spacing between the various conveyors may be adjusted or set so that the bow in the signature is removed by the belts before each individual signature exists as at 15. Upon discharge the signature falls into its associated hopper.

Although apparatus 11 has been described herein as a separate piece of equipment, it should be realized that it could readily be incorporated as desired into a larger piece of equipment or system.

In view of the above, it will be seen that the various objects and features of this invention are achieved and other advantageous results are obtained. As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of converting bundled signatures to a shingled stream suitable for feeding a finishing machine hopper or the like comprising the steps of:

conveying a signature bundle along a generally horizontal path upon a first set of conveyor belts to a shingling station, the signatures of said bundle being disposed generally at right angles to the path;

feeding the signature bundle through a restricted zone defined by a pair of side belts to bow the signatures of the bundle as they encounter the side belts to separate each signature from the other signatures of the bundle;

running the pair of side belts at a speed greater than the speed of movement of the first set of conveyor belts;

conveying the bowed signatures upwardly in a shingled condition from a discharge site of the side belts;

conveying the bowed signatures upwardly between a third set of conveyor belts in a shingled condition from the discharge site of the side belts, and moving said bowed signatures between said third set of conveyor belts and a plurality of backing belts disposed above the lower reaches of the third set of lifting belts, and passing said bowed signatures into a nip defined between the backing belts and third set of conveyor lifting belts; and moving said bowed signatures from the vertical lifting belts to a horizontally extending run for their feed-out and discharge from the apparatus.

2. Apparatus for converting bundled signatures to a shingled stream suitable for feeding a finishing machine hopper or the like comprising:

a first set of conveyor belts for moving a signature bundle to a shingling station, the top rungs of the belts of said first set generally defining a plane along which the bundle is moved;

means for driving the first set of conveyor belts to cause a signature bundle placed thereon to move along the path defined by the first set of belts toward the shingling station;

a pair of side belts defining the beginning of the shingling station, the side belts extending upwardly from the plane defined by the first set of belts on opposite sides of the path of the signature bundle, the spacing between the side belts being less than a predetermined signature width so that signatures from a bundle of signatures of the predetermined width disposed on the first set of conveyor belts with the longitudinal axis of the bundle generally parallel to the direction of travel of the bundle are bowed as they encounter the side belts to separate each signature from the other signatures of the bundle;

means for driving the side belts so that the inner run of the side belts moves in the same direction as the upper run of the first set of belts;

a third set of conveyor belts for moving the bowed signatures upwardly in a shingled condition from a discharge site of the side belts, means for adjusting the spacing between the side belts, and wherein the adjusting means includes at least one spacing bar disposed above the side belts for defining the spacing between the belts, said spacing bar having means for adjusting the position of at least one of the side belts with respect to the bar so as to change the spacing between the side belts.

3. The apparatus as set forth in claim 2 wherein the adjusting means includes a pair of spacing bars disposed above the side belts for defining the side belt spacing.

4. Apparatus for converting bundled signatures to a shingled stream suitable for feeding a finishing machine hopper or the like comprising:

a first set of conveyor belts for moving a signature bundle to a shingling station, the top runs of the belts of said first set generally defining a plane along which the bundle is moved;

means for driving the first set of conveyor belts to cause a signature placed thereon to move along the path defined by the first set of belts towards the shingling station;

a pair of side belts defining the beginning of the shingling station, the side belts extending upwardly from the plane defined by the first set of belts on opposite sides of the path of the signature bundle, the spacing between the side belts being less than a predetermined signature width so that signatures from a bundle of signatures of the predetermined width disposed on the first set of conveyor belts with the longitudinal axis of the bundle generally parallel to the direction of travel of the bundle are bowed as they encounter the side belts to separate each signature from the other signatures of the bundle; means for driving the side belts so that the inne run of the side belts moves in the same direction as the upper run of the first set of belts; and a third set of conveyor belts for moving the bowed signatures upwardly in a shingled condition from a discharge site of the side belts, said third set of belts includes a plurality of lifting belts disposed with their upwardly moving run facing the signatures, said third set of belts further includes a plurality of backing belts disposed above the lower reaches of the lifting belts, said lifting belts and backing belts together defining a nip of the third set of belts for securely grasping the shingled signatures for movement to an outlet of the apparatus, said nip being bowed an amount corresponding to the bow of the signatures.

5. The apparatus as set forth in claim 4 wherein the third set of belts define a bowed nip corresponding to the bow in the signatures imparted by the side belts.

6. Apparatus for converting bundled signatures to a shingled stream suitable for feeding a finishing machine hopper or the like comprising:

a first set of conveyor belts for moving a signature bundle to a shingling station, the top runs of the belts of said first set generally defining a plane along which the bundle is moved;

means for driving the first set of conveyor belts to cause a signature bundle placed thereon to move along the path defined by the first set of belts towards the shingling station;

a pair of side belts defining the beginning of the shingling station, the side belts extending upwardly from the plane defined by the first set of belts on opposite sides of the path of the signature bundle, the spacing between the side belts being less than a predetermined signature width so that signatures from a bundle of signatures of the predetermined width disposed on the first set of conveyor belts with the longitudinal axis of the bundle generally parallel to the direction of travel of the bundle are bowed as they encounter the side belts to separate each signature from the other signatures of the bundle;

means for driving the side belt so that the inner run of the side belts move in the same direction as the upper run of the first set of belts, said side belts running at a higher speed than the said first set of conveyor belts; and a third set of conveyor belts for moving the bowed signatures upwardly in a shingled condition from a discharge site of the side belts.

7. The apparatus as set forth in claim 6 and wherein said third set of conveyor belts running at a substantially greater speed than the speed of said first set of conveyor belts and the side belts.

8. The invention of claim 7 and wherein said first set of belts includes a plurality of generally parallel conveyor belts mounted generally side by side with respect to each other for conveyor movement with respect to fixed frame.

9. The invention of claim 6 and wherein one of the side belts is fixedly secured to a fixed frame and the other of the side belts is movable with respect to the fixed frame to change and spacing between the side belts.

10. The invention of claim 8 and wherein the third set of conveyor belts are disposed generally vertically.

11. The apparatus as set forth in claim 9 wherein the thid set of belts includes a plurality of lifting belts disposed with their upwardly moving run facing the signatures.

12. The invention of claim 11 and wherein the lower ends of said plurality of lifting belts forming the third set of belts extending downwardly and disposed below the upper surface of the said first set of conveyor belts.

13. The invention of claim 12 and wherein said plurality of lifting belts forming the third set of belts and the plurality of parallel belts forming the first set of conveyor belts being interdigitated with respect to each other.

14. The apparatus as set forth in claim 7 wherein the third set of belts further includes a plurality of backing belts disposed above the lower reaches of the lifting belts, said lifting belts and backing belts together defining a nip of the third set of belts for securely grasping the shingled signatures for movement to an outlet of the apparatus.

15. The apparatus as set forth in claim 14 wherein the third set of belts has an upwardly extending run followed by a horizontally extending run, so that the signatures are fed out of the apparatus horizontally.

16. The apparatus as set forth in claim 9 and further including means for adjusting the slack in the side belts.

17. The apparatus as set forth in claim 15 wherein the third set of belts define a bowed nip corresponding to the bow in the signatures imparted by the side belts.

* * * * *